US006396467B1

(12) United States Patent
Okita

(10) Patent No.: US 6,396,467 B1
(45) Date of Patent: May 28, 2002

(54) SYSTEM AND METHOD FOR DRIVING A NEMATIC LIQUID CRYSTAL

(75) Inventor: Masaya Okita, 7-10 Ebisu-minami 3-chome, Shibuya-ku Tokyo (JP)

(73) Assignees: Masaya Okita, Yono; FAD INC, Tokyo, both of (JP)

( * ) Notice: Subject to any disclaimer, the term of this patent is extended or adjusted under 35 U.S.C. 154(b) by 0 days.

(21) Appl. No.: 08/835,838

(22) Filed: Apr. 23, 1997

(30) Foreign Application Priority Data

Aug. 26, 1996 (JP) ..... 8-242703

(51) Int. Cl.[7] ..... G09G 3/36
(52) U.S. Cl. ..... 345/87; 345/94; 345/96
(58) Field of Search ..... 343/87, 94, 95, 343/96; 349/78, 87

(56) References Cited

FOREIGN PATENT DOCUMENTS

JP 1-179914 7/1989

*Primary Examiner*—Steven Saras
*Assistant Examiner*—Fritz Alphonse
(74) *Attorney, Agent, or Firm*—Flynn, Thiel, Boutell & Tanis, P.C.

(57) ABSTRACT

A system for driving a nematic liquid crystal in a liquid crystal display device which includes a nematic liquid crystal, a plurality of common electrodes and a plurality of segment electrodes confining the nematic liquid crystal therebetween, and a pair of polarizing plates sandwiching the common electrodes and the segment electrodes confining the nematic liquid crystal, comprises means for applying a sequence of selection pulses to the common electrodes; means responsive to the selection pulses to apply to the segment electrodes a voltage corresponding to image data to be displayed; and means for applying to the segment electrodes a voltage different from the voltage corresponding to the image data in intervals where the selection pulses are not applied. The voltage applied to the segment electrodes is controlled such that the mean value of the voltage be a predetermined constant value.

24 Claims, 7 Drawing Sheets

SYSTEM AND METHOD FOR DRIVING A NEMATIC LIQUID CRYSTAL

BACKGROUND OF THE INVENTION

This invention relates to a system and a method for driving a nematic liquid crystal.

When two transparent flat plates having transparent electrodes and sandwiching a nematic liquid crystal are placed between two polarizing plates, transmittance of light passing through the polarizing plates changes with voltages applied to the transparent electrodes.

Since liquid crystal display devices based on the above principle can be shaped flat and are operative with low electric power, they have been widely used in wrist watches, electronic calculating machines, and so forth.

In recent years, they are also used in combination with color filters to form color display devices in note-type personal computers and small liquid crystal TV sets, for example.

There are some known types of dot matrix drive systems. A group of such systems is simple matrix drive systems having a simple structure. Another group is active matrix systems including TFT systems that can realize high-quality images by adding active elements to individual pixels.

Active elements are very difficult to make. Therefore, active matrix systems are expensive and need a large amount of investment for manufacturing facilities. However, they can use TN-type nematic liquid crystals that are advantageous for realizing high-quality images with a high contrast ratio, wide visual angle and multi-gradation.

Simple matrix drive systems have the merit that electrodes of liquid crystal panels can be made very easily. However, they involve the problem that the contrast ratio decreases as the duty ratio becomes high. Therefore, large-scaled matrix liquid crystal panels having a high duty ratio have been compelled to use STN-type nematic liquid crystals that are disadvantageous in contrast ratio, visual angle, response speed and multi-gradation.

In liquid crystal displays combined with color filters to display color images, three dots of different colors, namely, red, green and blue, are combined to display a desired color. However, color filters are very expensive and need a high accuracy when bonded to panels. Moreover, they need a triple number of dots to ensure an equivalent resolution as compared with black-and-white liquid crystal display panels. Therefore, liquid crystal color panels require a triple number of drive circuits typically in the horizontal direction. This means an increase of the cost of drive circuits themselves and the cost for an increased manhour for connecting drive circuits to the panel at a triple number of points.

That is, the use of color filters with liquid crystal panels to display color images involves many disadvantageous factors from the economical viewpoint.

To avoid the problems caused by the use of color filters, color liquid crystal display devices as disclosed in Japanese Patent Laid-Open 1-179914 (1989) have been proposed to display color images by combining a black-and-white panel and three-color back-lighting in lieu of color filters. Certainly, this method seems more likely to realize high-fidelity color images economically. Actually, however, because of the difficulty in driving liquid crystals at a high speed with conventional drive techniques, no such device has been brought into practice.

Another problem with conventional liquid crystal display devices is slow responses of liquid crystals. Due to this, liquid crystal display devices have been inferior to CRT displays especially when used as TV displays for displaying moving images or as personal computer displays required to follow quick movements of a mouse cursor.

Typical nematic liquid crystals have electro-optic characteristics substantially as shown in FIG. 1 in which the effective value of an applied voltage is material regardless of its polarities.

A driving method called active driving method has been proposed recently as one of driving methods using STN liquid crystal panels to realize a quality of images equivalent to that of TFT liquid crystal panels. That is, in order to improve the contrast ratio and the response speed, the active driving method relies on the approach that selects a plurality of scanning lines simultaneously to select scanning lines more often in each frame period. This is substantially the same as the conventional driving method in relying on the belief that the optical transmittance of a nematic liquid crystal exclusively depends on the effective value of an applied voltage.

Since nematic liquid crystals need time as much as decades of milliseconds to hundreds of milliseconds for response, it has been believed impossible to realize a speed of response acceptable for displaying color images by three-color back lighting.

SUMMARY OF THE INVENTION

The Inventor, however, has found that a specific status of applied voltage waveforms causes quick changes in optical transmittance with change in applied voltage level, while he measured dynamic characteristics of optical transmittance of nematic liquid crystals relative to waveforms of applied voltages for the purpose of developing a liquid crystal panel having a speed of response high enough to realize color images by three-color back lighting.

By using this phenomenon and by repeatedly generating the above-mentioned specific status, it has been made possible to drive nematic liquid crystals at a much higher speed with a higher contrast ratio than those by conventional drive techniques.

On the basis of the above knowledge, an object of the invention is to provide a new system and a method for driving a nematic liquid crystal which can increase the speed of response of any conventional nematic liquid crystals, either TN-type or STN-type, to a value high enough to ensure a performance equivalent to or higher than the performance of a CRT display system when displaying color images by the three-color back-lighting method or reproducing moving images.

Another object of the invention is to provide a matrix drive system and a matrix drive method of a nematic liquid crystal which realize both a high contrast ratio and a high response speed.

Another object of the invention is to provide a system and a method for driving a nematic liquid crystal which provides a high contrast ratio even in a large-scaled matrix liquid crystal panel having a high duty ratio and driven by the simple matrix drive system even when a TN-type nematic liquid crystal is used.

The invention is basically characterized in applying a voltage to a liquid crystal at a timing different from that of a conventional liquid crystal drive circuit to keep the contrast ratio high even when the duty ratio is high and to increase the response speed of the liquid crystal.

According to the present invention, there is provided a system for driving a nematic liquid crystal in a liquid crystal display device which includes a nematic liquid crystal, a plurality of common electrodes and a plurality of segment electrodes confining the nematic liquid crystal therebetween, and a pair of polarizing plates sandwiching the common electrodes and the segment electrodes confining the nematic liquid crystal, comprising:

means for applying a sequence of selection pulses to the common electrodes;

means responsive to the selection pulses to apply to the segment electrodes a voltage corresponding to image data to be displayed; and means for applying to the segment electrodes a voltage different from the voltage corresponding to the image data in intervals where the selection pulses are not applied, the voltage applied to the segment electrodes being controlled such that the mean value thereof be a predetermined constant value.

According to another aspect of the invention, there is provided a method for driving a nematic liquid crystal in a liquid crystal display device which includes a nematic liquid crystal, a plurality of common electrodes and a plurality of segment electrodes confining the nematic liquid crystal therebetween, and a pair of polarizing plates sandwiching the common electrodes and the segment electrodes confining the nematic liquid crystal, comprising the steps of:

applying a sequence of selection pulses to the common electrodes;

in response to the selection pulses, applying to the segment electrodes a voltage corresponding to image data to be displayed;

applying to the segment electrodes a voltage different from the voltage corresponding to the image data in intervals where the selection pulses are not applied, the voltage applied to the segment electrodes being controlled such that the mean value thereof be a predetermined constant value.

In both aspects of the invention, the voltages to the common electrode and the segment electrode are preferably determined such that the voltage to the segment electrode be inverted in polarity when the selection pulse is applied to the common electrode.

The system preferably includes heater means for heating the nematic liquid crystal to a predetermined temperature.

DESCRIPTION OF THE PREFERRED EMBODIMENTS

Figure 2:
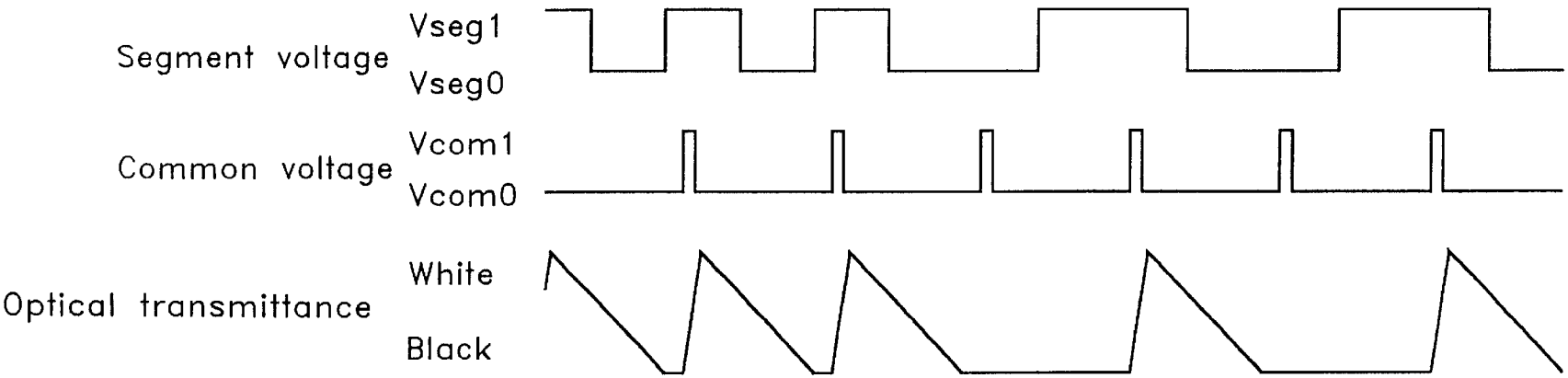
FIG. 2 is a diagram showing changes in optical transmittance with time and with voltage applied to a nematic liquid crystal according to the present invention.

Explained below is an embodiment of the invention with reference to the drawings. FIG. 2 shows an aspect of optical transmittance of a nematic liquid crystal and applied voltages of a single dot in a nematic liquid crystal panel using a simple matrix method. More specifically, FIG. 2 shows changes in optical transmittance on a time base in relation to voltages applied to the segment electrode and the common electrode of a single dot.

As shown in FIG. 2, the voltage applied to the common electrode generates a sequence of pulses only when the common electrode is selected (hereinafter called common selected periods). When the voltage applied to the segment electrode is Vseg1 in the duration of a pulse to the selected common electrode, the optical transmittance of the dot changes instantaneously. When the voltage applied to the segment electrode is Vseg0 in the duration of a pulse, the optical transmittance of the dot does not change. Therefore, when a voltage corresponding to image data is applied to the segment electrode in response to the timing of pulses to the common electrode, images corresponding to the image data can be displayed.

It is important for the driving mode used in this embodiment that, in a frame where the segment voltage level is Vseg1 in the common selected period, the segment voltage level is changed to Vseg0 within the other period of the same frame where the common electrode is not selected (hereinbelow called common non-selected periods).

Figure 1:
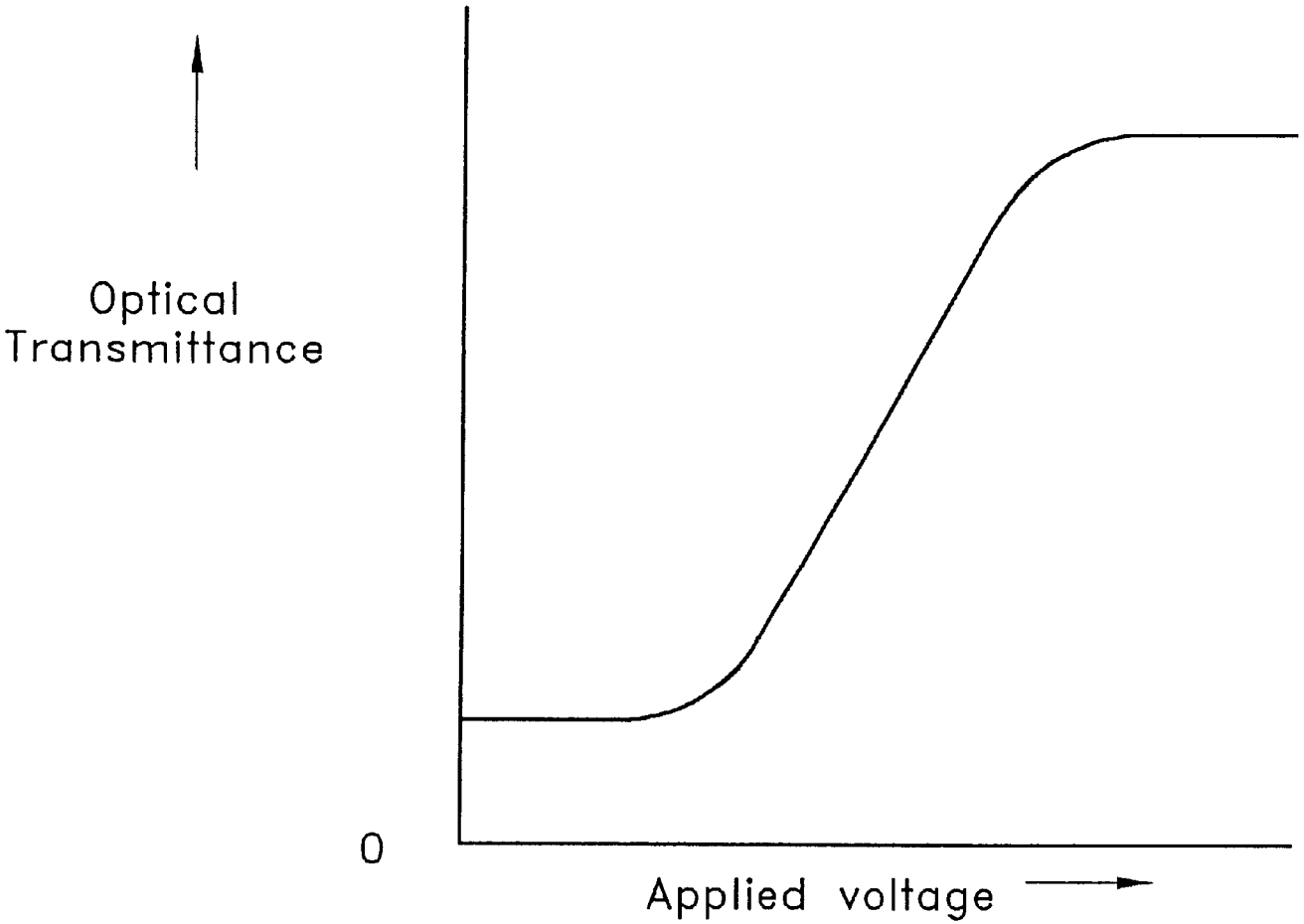
FIG. 1(PRIOR ART)
FIG. 1 is a diagram showing electro-optic characteristics of a nematic liquid crystal.
Figure 3:
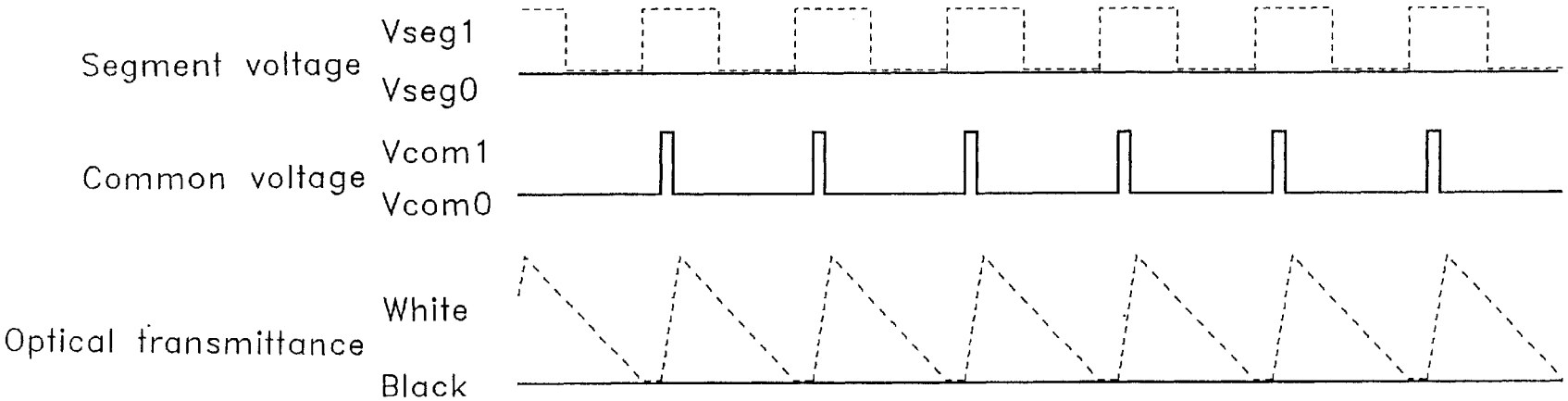
FIG. 3 is a diagram showing changes in optical transmittance with time and with voltage applied to a nematic liquid crystal while maintaining the segment voltage constant.
Figure 4:
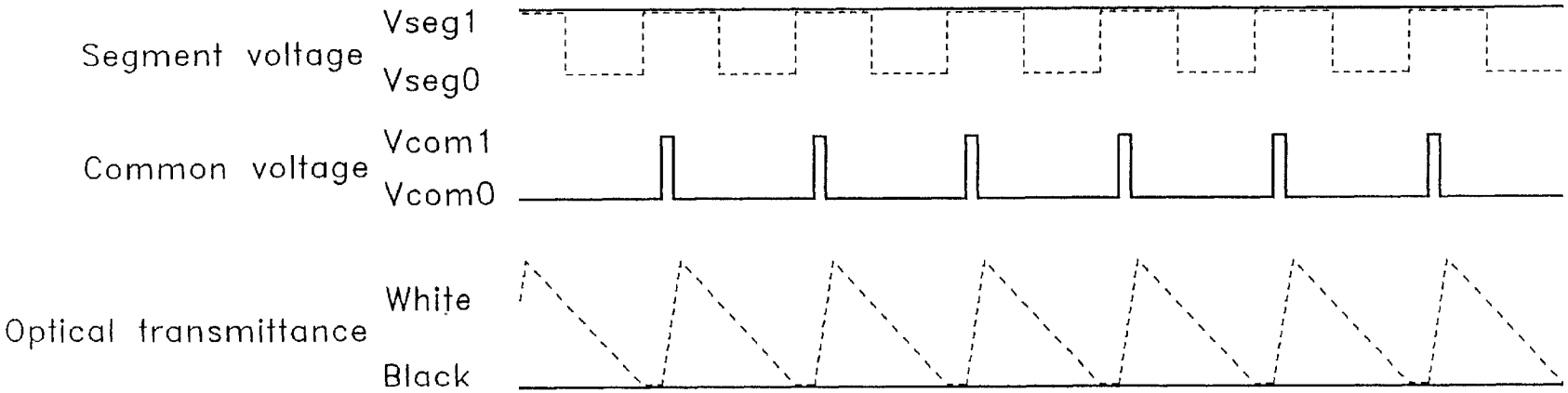
FIG. 4 is a diagram showing changes in optical transmittance with time and with voltage applied to a nematic liquid crystal while maintaining the segment voltage constant.

FIGS. 3 and 4 show voltage waveforms applied by a conventional technique (solid lines) in comparison with those applied by the embodiment of the present invention (broken lines). One difference between the conventional technique and the present invention is that the voltage level applied to the segment electrode is constant in the conventional technique and varies using the present invention. All of FIGS. 2, 3 and 4 are shown as using a typical TN liquid crystal exhibiting moderate changes in electro-optical characteristics among various nematic liquid crystals as shown in FIG. 1.

If it is true that the optical transmittance of a liquid crystal exclusively depends on the effective value of the voltage applied in a common selected period as conventionally believed, as long as the optical transmittance is low and constant when the segment voltage level is constant, either Vseg0 (FIG. 3) or Vseg1 (FIG. 4), the optical transmittance should remain unchanged even when the segment voltage level changes between Vseg0 and Vseg1 as shown in FIG. 2. Actually, however, the optical transmittance certainly changes as shown in FIG. 2 even when using the typical TN liquid crystal and a panel with a normal thickness, namely with the gap of approximately 5 $\mu$m to 6 $\mu$m. It takes only 15 ms to 20 ms for the optical transmittance to return to its original value after it begins to change in response to a change in common voltage level. That is, the nematic liquid crystal behaves very quickly.

Quick changes in optical transmittance are most salient when Vcom0 is lower than Vseg0 and Vcom 1 is higher than Vseg1, that is, when the polarity of the voltage applied in a common selected period is inverted from the polarity of the voltage applied in a common non-selected period.

Figure 5:
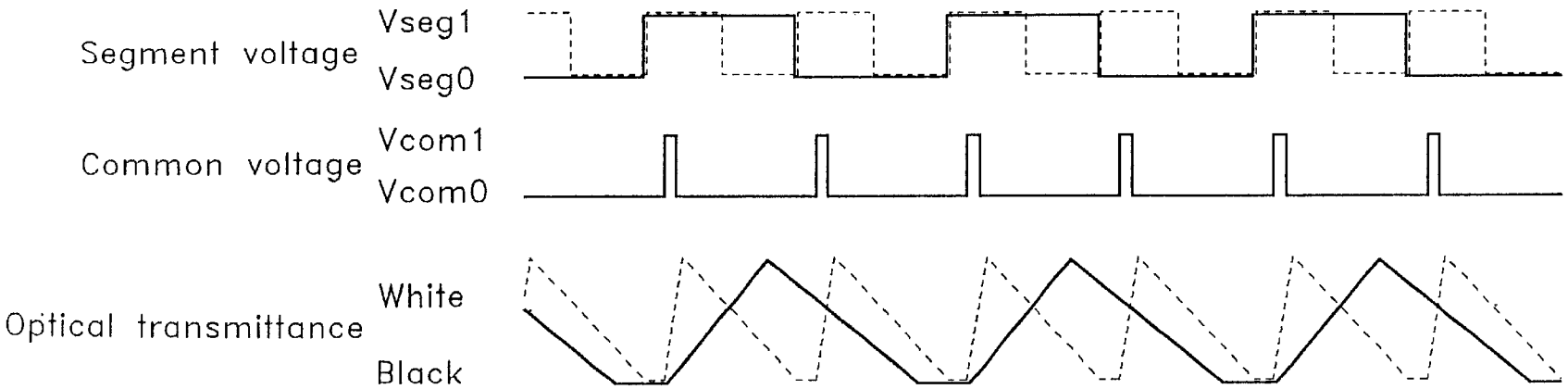
FIG. 5 is a diagram showing changes in optical transmittance with time and with voltage applied to a nematic liquid crystal when the segment voltage changes in intervals of a double length.

FIG. 5 shows how the optical transmittance varies in the embodiment of the invention when the interval for changing the segment voltage level is modified. As shown in FIG. 5, when the segment voltage level is changed from one frame to another, the optical transmittance varies much slower than the speed obtained by changing the segment voltage level within each frame. That is, by changing the segment voltage in faster cycles (shorter intervals), the optical transmittance of a liquid crystal can be changed more quickly.

A problem with the simple matrix drive system is a cross talk that is an undesirable response of a liquid crystal to a segment voltage applied while the common electrode is not selected (hereinbelow called a non-selected period). To prevent the cross talk problem, conventionally used was a system called voltage averaging method which maintains the effective value of the applied voltage waveform substantially constant in non-selected periods.

Figure 6:
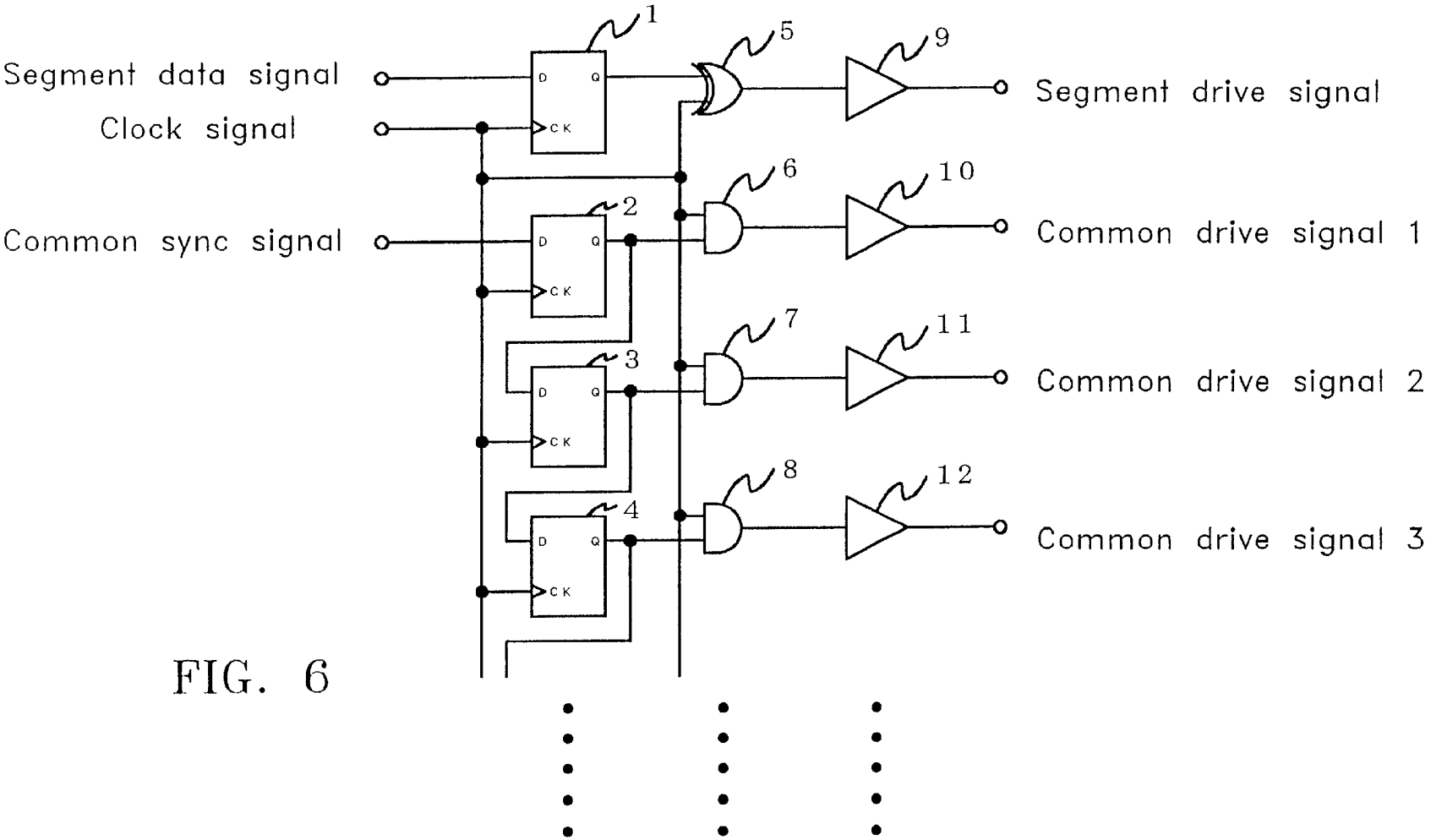
FIG. 6 is a circuit diagram of an embodiment of the invention.

Even when the circuit of FIG. 6 is used, if the simple matrix drive system is used to drive a liquid crystal, then the optical transmittance of the liquid crystal inevitably changes with applied voltage waveforms in non-selected intervals.

In the driving method according to the embodiment of the invention, as long as the mean value, and not the effective value, of the applied voltage is constant in non-selected intervals, the optical transmittance is not adversely affected by the applied voltage waveform in non-selected intervals. Therefore, effection of applied voltage waveforms in non-selected intervals can be removed using a simpler circuit than those of the conventional driving systems.

FIG. 6 shows a driving circuit embodying the invention, in which numerals 1 through 4 denote D flip flops. Numeral 5 refers to an exclusive OR (XOR) gate, numerals 6 to 8 refer to AND gates, 9 refers to a segment drive buffer, and 10 through 12 to common drive buffers.

FIG. 6 shows the circuit as containing only one segment drive circuit and only three common drive circuits for simplicity. Typically, however, the circuit includes more such circuits for respective segment and common electrodes to drive any desired number of dots by the matrix drive system.

Figure 7:
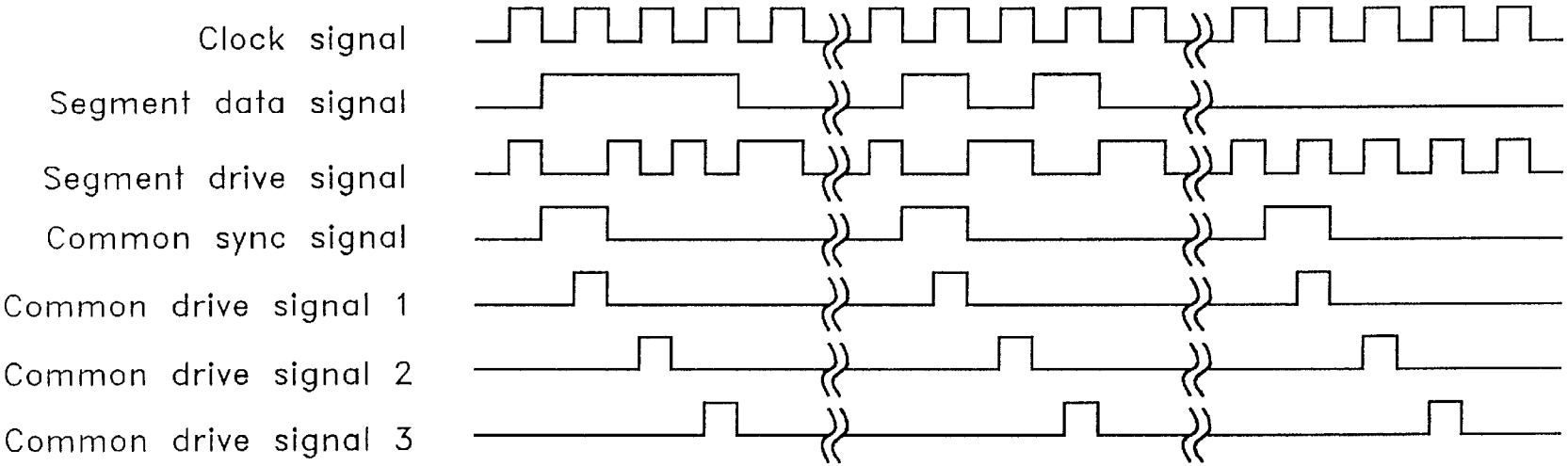
FIG. 7 is a timing chart showing behaviors of different portions of the circuit shown in FIG. 6.

FIG. 7 is a timing chart showing behaviors of the driving circuit of FIG. 6.

With reference to FIGS. 6 and 7, the clock signal is from a clock has the duty ratio of 1:1. The segment data signal is latched by the D flip flop 1 in response to the clock signal. An exclusive logical sum of the clock signal and the segment data signal is made in the XOR gate 5, and output through the segment drive buffer 9.

D flip flops 2, 3 and 4 shift in response to the common sync signal at the rising of the clock signal. AND gates 6, 7 and 8 make logical products of the clock signal and the common sync signal, and output them through the common drive buffers 10, 11 and 12 as common drive signals 1, 2 and 3.

Therefore, in the embodiment shown in FIGS. 6 and 7, a voltage responsive to the segment data signal can be output to the segment electrode in intervals where the common electrode is selected (in common selected periods), and the voltage of the segment electrode in common non-selected periods can be quickly changed to a voltage different from that in common selected periods. That is, the liquid crystal can be activated at a high speed.

Moreover, since the mean value of the segment drive signal within one cycle (gate period) from a rising to the next rising of the clock signal can be held constant, the cross talk problem can be removed with a simple circuit without using a voltage averaging process that was indispensable in conventional techniques. FIG. 7 shows the segment drive signal always having a constant mean value for each clock cycle (gate period), even during selected and non-selected periods. Further, FIG. 7 shows for each frame, for example from the rising edge of the selection pulse (common drive signal) to the rising edge of the next corresponding pulse, the voltage to the segment electrodes having the same mean value as other corresponding frames. In FIG. 7, the segment electrodes receive a segment drive signal corresponding to image data to be displayed. The common electrodes sequentially are selected by common drive signals. Gate periods are defined by the time period between the sequential selection pulses represented as common drive signals 1, 2 and 3. The gate periods thus are the same as the clock cycles of the clock signal. The selected period corresponds to the sum of sequential common drive signals. The non-selected period follows the selected period and ends with the beginning of the first common drive signal of a series of sequential drive signals. The mean value of the absolute voltage of the segment drive signal equals a predetermined constant value for each frame and the respective selected and non-selected time periods.

In order to ensure images with a high contrast ratio, it is preferred that a subsequent pulse be applied after the optical transmittance of the liquid, once changed instantaneously by a preceding pulse to the common electrode before the liquid, returns to the original value.

That is, as the frame cycle becomes shorter, the contrast ratio becomes lower. However, as the frame cycle becomes longer, flickers are liable to occur.

In order to overcome these contradictory problems simultaneously, some approaches are shown below.

As explained before, the cycle for changing the segment voltage level in the non-selected period largely affects the speed of changes in optical transmittance in the embodiment of the invention. Furthermore, the time required for the optical transmittance to return to its original value largely varies with natures of liquid crystals, and particularly with viscosities of liquid crystals. Therefore, by selecting a liquid crystal whose optical transmittance returns to the original value in a short time, images having a high contrast ratio and substantially no flickers can be realized.

Another approach is to heat the liquid crystal panel because the time for returning the optical transmittance to its original value is largely affected by the viscosity of the liquid crystal. This is advantageous in providing images of a high contrast ratio without using special kinds of liquid crystals as required in the former approach.

As described above, according to the invention, since an image is displayed and erased within each frame period, a system having a very high response speed and optimum for reproduction of moving images can be obtained.

Additionally, the invention not only enables the use of a nematic liquid crystal in a simple matrix liquid crystal panel but also realizes a much higher response speed, equivalent contrast ratio, equivalent or larger visual angle as compared with a conventional TFT liquid crystal panel. It is also possible to apply the invention to a conventional TFT liquid crystal panel to improve the operating speed of the TFT liquid crystal panel.

Moreover, the driving circuit used in the invention can be realized at a cost equivalent to that of a conventional simple matrix driving system because the invention uses less kinds of drive voltages and an easier driving timing as compared with those of a conventional active driving system that uses many kinds of drive voltages and a complex structure for the controller, which inevitably increases the cost of the driving circuit.

The invention ensures quick appearance and disappearance of an image on a liquid crystal panel, is optimum for applications displaying color images using three color backlighting, and can realize a high-performance, inexpensive color display.

What is claimed is:

1. A system for driving a nematic liquid crystal in a liquid crystal display device which includes a nematic liquid crystal, a plurality of common electrodes and a plurality of segment electrodes confining the nematic liquid crystal therebetween, and a pair of polarizing plates sandwiching the common electrodes and the segment electrodes confining the nematic liquid crystal, comprising:

means for applying a sequence of selection pulses to said common electrodes;

means for applying a voltage corresponding to image data to be displayed to said segment electrodes in intervals where said selection pulses are applied; and means for applying a second voltage related to said voltage corresponding to image data in intervals where said selection pulses are not applied, said second voltage being determined such that the mean value of effective values of applied voltages is a predetermined constant value for each frame and the same mean value for each subsequent frame, thereby removing cross talk.

2. The system for driving a nematic liquid crystal according to claim 1, wherein said voltages applied to said common electrode and said segment electrode are determined to invert a voltage applied to said liquid crystal after each said selection pulse is applied to said common electrode.

3. The system for driving a nematic liquid crystal according to claim 1, wherein said voltage applied to said segment electrodes is controlled such that the mean value for a gate period of each frame equals the predetermined constant value.

4. The system for driving a nematic liquid crystal according to claim 3, wherein the value of the voltage applied to the segment electrodes changes once during each gate period.

5. The system for driving a nematic liquid crystal according to claim 1, wherein the nematic liquid crystal display device comprises a simple matrix liquid crystal display.

6. A method for driving a nematic liquid crystal in a liquid crystal display device which includes a nematic liquid crystal, a plurality of common electrodes and a plurality of segment electrodes confining the nematic liquid crystal therebetween, and a pair of polarizing plates sandwiching the common electrodes and the segment electrodes confining the nematic liquid crystal, comprising the steps of:

applying a sequence of selection pulses to said common electrodes, a time between consecutive selection pulses on one common electrode comprising a frame;

applying to said segment electrodes a voltage corresponding to image data to be displayed during respective gate periods of each of the common electrodes, the gate periods corresponding to time periods between sequential selection pulses of adjacent common electrodes, the gate periods in combination, comprising a selected period;

applying to said segment electrodes a voltage related to said voltage corresponding to the image data in a non-selected period where said selection pulses are not applied, said voltage applied to said segment electrodes being controlled such that the mean value thereof is a predetermined constant value for each selected period and the same mean value for each non-selected period of each frame.

7. The method for driving a nematic liquid crystal according to claim 6, wherein said voltages applied to said common electrode and said segment electrode are determined to invert a voltage applied to said liquid crystal after each said selection pulse is applied to said common electrode.

8. The method for driving a nematic liquid crystal according to claim 6, wherein the voltage applied to the segment electrodes is controlled such that for each gate period of each frame the mean value equals the predetermined constant value.

9. The method for driving a nematic liquid crystal according to claim 8, wherein the value of the voltage applied to the segment electrodes changes once during each of the gate periods.

10. The method for driving a nematic liquid crystal according to claim 6, wherein the nematic liquid crystal display device comprises a simple matrix liquid crystal display.

11. A system for driving a simple matrix nematic liquid crystal in a liquid crystal display device which includes a nematic liquid crystal, a plurality of common electrodes and a plurality of segment electrodes confining the nematic liquid crystal therebetween, and a pair of polarizing plates sandwiching the common electrodes and the segment electrodes, comprising:

means for generating a sequence of selection pulses;

means for applying said selection pulses to said common electrodes;

means for generating a segment drive signal in relation to an image data signal so that the mean value of absolute values of voltages of said segment drive signal equals a predetermined constant value for each frame and the same mean value for each subsequent frame; and means for applying said segment drive signal to said segment electrodes, thereby eliminating cross talk.

12. The system of claim 11, wherein said means for generating a segment drive signal includes a clock generating a clock signal having a duty ratio of 1:1.

13. The system of claim 12, wherein said means for generating a segment drive signal includes a flip-flop for receiving the image data signal and the clock signal as inputs.

14. The system of claim 13, wherein said means for generating a segment drive signal includes an Exclusive-Or gate receiving the clock signal and an output of the flip-flop to provide the segment drive signal.

15. The system of claim 11, wherein said means for generating a sequence of selection pulses for said common electrodes comprises flip-flops connected in series and coupled with a clock to inputs of respective AND gates.

16. The system of claim 11, wherein the mean value of the voltage of said segment drive signal for a gate period of each frame equals the predetermined constant value, the gate period comprising a time period between consecutive sequences of selection pulses of said common electrodes.

17. The system for driving a simple matrix nematic liquid crystal according to claim 16, wherein the value of the voltage applied to the segment electrodes changes during each of the gate periods.

18. The system for driving a nematic liquid crystal according to claim 11, wherein the nematic liquid crystal display device comprises a simple matrix liquid crystal display.

19. A method for driving a simple matrix nematic liquid crystal in a liquid crystal display device which includes a nematic liquid crystal, a plurality of common electrodes and a plurality of segment electrodes confining the nematic liquid crystal therebetween, and a pair of polarizing plates sandwiching the common electrodes and the segment electrodes, comprising the steps of:

inputting a clock signal and a common synch signal into a plurality of connected flip-flops to generate a sequence of selection pulses;

applying the selection pulses to the common electrodes;.

inputting an image data signal and a clock signal into a flip-flop wherein the clock signal latches the image data signal;

comparing the output of the flip-flop with a clock signal in an exclusive-OR gate to provide a segment drive signal in response to the image data signal and controlling the mean value of the voltage of the segment drive signal to equal a predetermined constant value for each frame; and applying the segment drive signal to the segment electrodes.

20. The method for driving a simple matrix nematic liquid crystal according to claim 19, wherein the voltage applied to the segment electrodes is controlled such that the mean value for a gate period of each frame equals the predetermined constant value, the gate period comprising a time period between sequential sequences of selection pulses.

21. The method for driving a simple matrix nematic liquid crystal according to claim 20, wherein the voltage applied to the segment electrodes is controlled such that the value of the voltage applied to the segment electrodes changes once during each gate period.

22. The method for driving a simple matrix nematic liquid crystal according to claim 19, wherein the voltage applied to the segment electrodes is controlled such that the mean value of the voltage of the segment drive signal for both selected periods and nonselected periods of each frame equals the predetermined constant value.

23. The method for driving a simple matrix nematic liquid crystal according to claim 19, wherein the step of generating a segment drive signal includes applying to the segment electrodes a voltage different from the voltage corresponding to the image data in intervals where the selection pulses are not applied.

24. The method for driving a nematic liquid crystal according to claim 19, wherein the nematic liquid crystal display device comprises a simple matrix liquid crystal display.

* * * * *